US012698765B2

(12) United States Patent
Righa et al.

(10) Patent No.: US 12,698,765 B2
(45) Date of Patent: Aug. 4, 2026

(54) SOUND REDUCTION DEVICE FOR ROCKING PISTON COMPRESSORS

(71) Applicant: Gast Manufacturing, Inc., Benton Harbor, MI (US)

(72) Inventors: Righa M. Righa, Benton Harbor, MI (US); William Otte, Benton Harbor, MI (US)

(73) Assignee: Gast Manufacturing, Inc., Benton Harbor, MI (US)

( * ) Notice: Subject to any disclaimer, the term of this patent is extended or adjusted under 35 U.S.C. 154(b) by 286 days.

(21) Appl. No.: 18/476,593

(22) Filed: Sep. 28, 2023

(65) Prior Publication Data

US 2024/0110555 A1 Apr. 4, 2024

Related U.S. Application Data

(60) Provisional application No. 63/411,711, filed on Sep. 30, 2022.

(51) Int. Cl.
*F04B 39/00* (2006.01)
*F04B 27/00* (2006.01)
(Continued)

(52) U.S. Cl.
CPC ..... *F04B 39/0055* (2013.01); *F04B 27/005* (2013.01); *F04B 39/1066* (2013.01); *F04B 39/125* (2013.01)

(58) Field of Classification Search
CPC ..... F04B 39/0061; F04B 39/0055; F04B 39/0072; F04B 39/005; F04B 39/0027; F04B 39/12; F04B 39/121; F04B 39/125; F04B 39/10; F04B 39/1066; F04B 39/1073; F04B 39/108; F04B 39/1086; Y10S 181/403
See application file for complete search history.

(56) References Cited

U.S. PATENT DOCUMENTS 3,504,762 A 4/1970 Knud, V et al.
6,007,307 A 12/1999 Sonoda
(Continued)

FOREIGN PATENT DOCUMENTS

CN 1671963 A 9/2005
CN 104612941 A 5/2015
(Continued)

*Primary Examiner* — Essama Omgba
*Assistant Examiner* — Chirag Jariwala
(74) *Attorney, Agent, or Firm* — Tucker Ellis LLP; Patrick F. Clunk; Bennett E. Kuhar

(57) ABSTRACT

One or more techniques and/or systems are disclosed for a rocking piston compressor comprising a head plate having at least one inlet and silencer port, an exhaust and an exhaust port. The compressor may comprise valve plate coupled to the head plate and having a sound attenuation chamber and an exhaust chamber. The compressor may have at least one silencer selectably coupled to a head plate silencer port and disposed within the sound attenuation chamber. The compressor may also comprise an air tube having a first end selectably coupled to the head plate air tube port and a second end disposed within the valve plate exhaust chamber. The air tube may be configured to accelerate air flow from the second end toward the first end.

15 Claims, 19 Drawing Sheets

(51) Int. Cl.
*F04B 39/10* (2006.01)
*F04B 39/12* (2006.01)

(56) References Cited

U.S. PATENT DOCUMENTS

| | | | |
|---|---|---|---|
| 6,840,746 | B2 | 1/2005 | Marshall et al. |
| 9,863,412 | B2 | 1/2018 | Blackburn |
| 11,542,933 | B2 | 1/2023 | Kuntz et al. |
| 2005/0023077 | A1 | 2/2005 | Sishtla |
| 2006/0251527 | A1 | 11/2006 | Wester |
| 2010/0310389 | A1 | 12/2010 | Alvarenga |
| 2014/0161640 | A1 | 6/2014 | Geue et al. |
| 2018/0291885 | A1 | 10/2018 | Grybush et al. |
| 2020/0340468 | A1 | 10/2020 | Kuntz et al. |
| 2021/0310472 | A1* | 10/2021 | Kim et al. ..... F04B 39/1066 |

FOREIGN PATENT DOCUMENTS

| | | | |
|---|---|---|---|
| CN | 104781553 | A | 7/2015 |
| CN | 108204353 | A | 6/2018 |
| EP | 2570668 | A3 | 3/2017 |
| WO | 2014053039 | A1 | 4/2014 |
| WO | 2014059504 | A1 | 4/2014 |
| WO | 2014053039 | A8 | 8/2016 |
| WO | 2016127702 | A1 | 8/2016 |

* cited by examiner

SOUND REDUCTION DEVICE FOR ROCKING PISTON COMPRESSORS

This nonprovisional patent application claims priority to provisional application having application No. 63/411,711 filed on Sep. 30, 2022, all of which is incorporated herein by reference.

BACKGROUND

Sound attenuation and heat reduction are desired for rocking piston vacuum pumps and compressors. The operation of rocking piston compressors, especially large compressors, can produce a substantial amount of noise. Exposure to this noise in a working environment can be distracting. Additionally, a rocking piston compressor generates heat and hot air is exhausted during operation to an undesirable level resulting in inefficiencies. As such, reducing noise and mitigating heat produced by rocking piston compressors is desired.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In one implementation, the disclosed rocking piston compressor head assembly may comprise a head plate having at least one inlet, at least one silencer port, an air tube port, and an external exhaust port. The head assembly may further comprise a valve plate configured to be operably coupled to the head plate. The valve plate may have a sound attenuation chamber and an exhaust chamber. The head assembly may include at least one silencer. The silencer may be operably and selectably coupled to the silencer port and disposed within the sound attenuation chamber. The head assembly may further include an air tube. The air tube may have a first end operably and selectably coupled to the head plate air tube port and a second end opposite the first end. The air tube may be configured to accelerate air flow from the second end toward the first end.

In another implementation, the disclosed rocking piston compressor head assembly may have a head plate and a valve plate configured to be operably coupled to the head plate. The valve plate may comprise a sound attenuation chamber, an exhaust chamber, a first end, and a second end. The first end of the valve plate may comprise an intake port, an intake port leaf valve disposed over the intake port, a plurality of discharge ports, and a discharge port leaf valve disposed proximate the plurality of discharge ports. Similarly, the second end of the valve plate may comprise an intake port, an intake port leaf valve disposed over the intake port, a plurality of discharge ports, and a discharge port leaf valve disposed proximate the plurality of discharge ports.

In another implementation, the disclosed rocking piston compressor head assembly may have a head plate having at least one inlet, at least one silencer port, an air tube port, and an external exhaust port. The head assembly may further comprise a valve plate configured to be operably coupled to the head plate. The valve plate may have a sound attenuation chamber an exhaust chamber, a first end, and a second end. The first end of the valve plate may comprise an intake port, an intake port leaf valve disposed over the intake port, a plurality of discharge ports, and a discharge port leaf valve disposed proximate the plurality of discharge ports. Similarly, the second end of the valve plate may comprise an intake port, an intake port leaf valve disposed over the intake port, a plurality of discharge ports, and a discharge port leaf valve disposed proximate the plurality of discharge ports. The first end plurality of discharge ports may have one-half of the area of the first end intake port and the second end plurality of discharge ports may have one-half the area of the second end intake port. The head assembly may include at least one silencer. The silencer may be operably and selectably coupled to the silencer port and disposed within the sound attenuation chamber.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
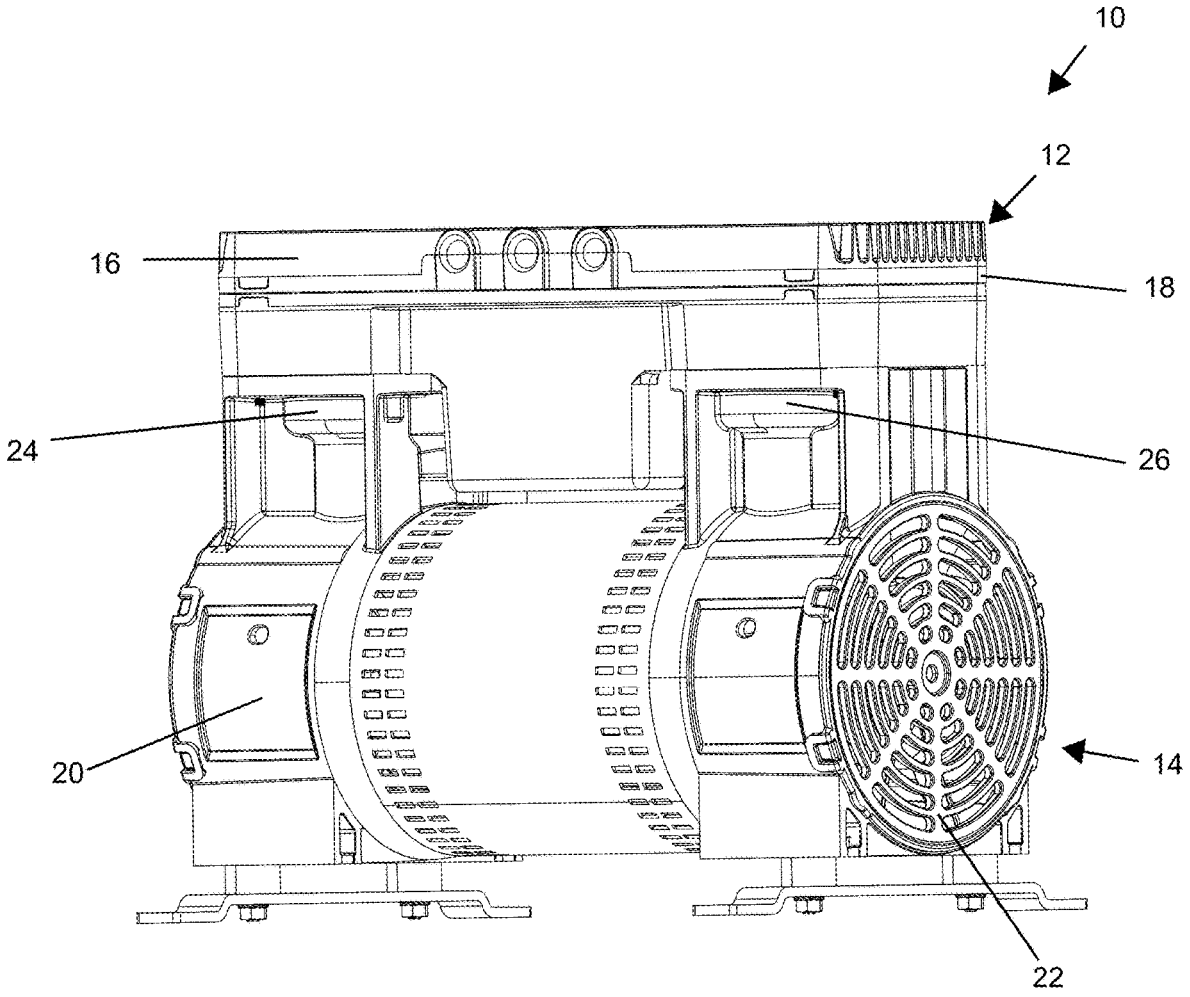
FIG. 1 is a perspective view of an assembled compressor.
Figure 2:
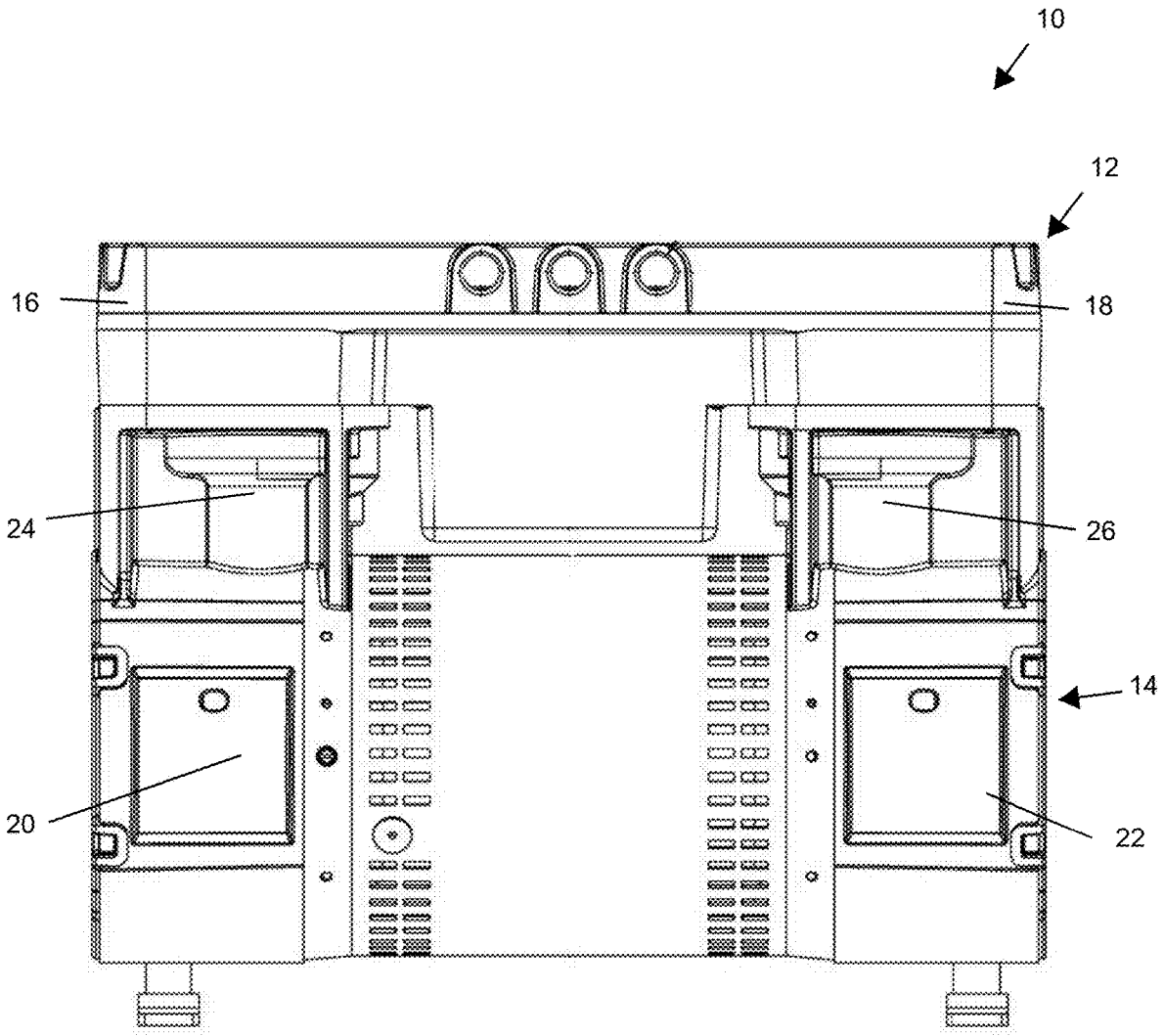
FIG. 2 provides a front view of the assembled compressor.
Figure 3:
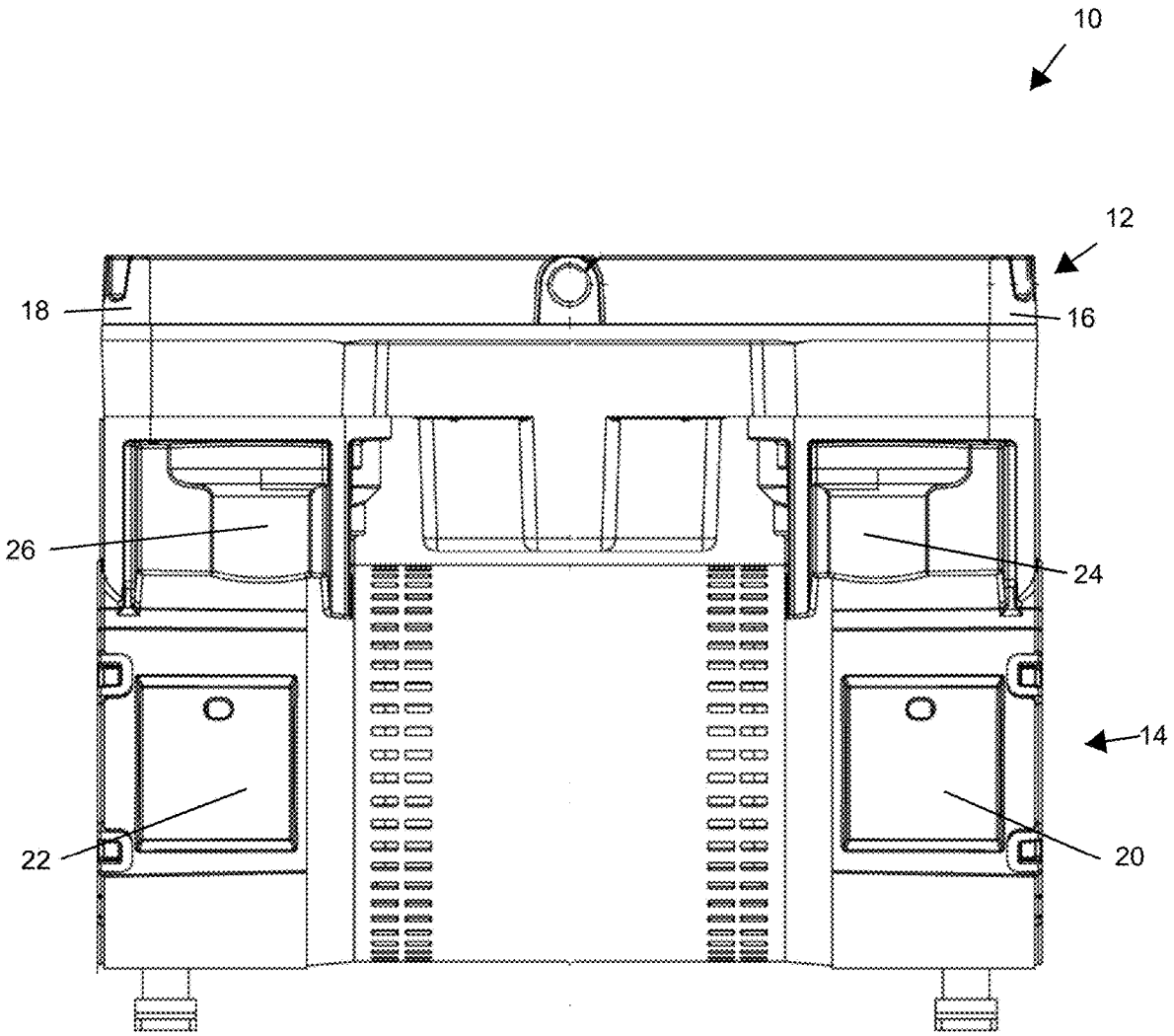
FIG. 3 provides a back view of the assembled compressor.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

The disclosed dual cylinder rocking piston-type compressor may include one or a plurality of silencers plumbed in parallel and selectably and operably connected to a sound attenuation chamber, which decreases the operating sound of the compressor. The compressor may further comprise at least one valve limiter with slots that minimize the force applied to one-way directional valves, such as leaf valves, within the compressor and further minimize mechanical noise during compressor operation. These features may reduce the operation noise by 5-10 decibels producing a quieter compressor. Additionally, the head of the compressor may include heat fins that increase the surface area of the compressor head thereby dissipating heat generated and exhausted by compressor operation. The disclosed heat fins may decreased the head and exhaust temperature by approximately 40 degrees Celsius (104 degrees Fahrenheit). Accordingly, the disclosed compressor operates quieter and cooler than common dual cylinder rocking piston-type compressors.

FIG. 1 illustrates a disclosed dual cylinder rocking piston-type compressor 10 with a head assembly 12 and a motor assembly 14. The head assembly 12 may comprise a first end 16 and a second end 18 that are substantially similar. The motor assembly 14 may comprise a first end 20 and a second end 22 that are substantially similar. The motor first end 20 may comprise a first cylinder 24. The motor second end 22 may comprise a second cylinder 26. The motor assembly 14 may comprise a first rocking piston assembly 28, which may include a first piston head 32. The motor assembly 14 may comprise a second rocking piston assembly 30, which may include a second piston head 34. The piston heads 32, 34 may be slidably and sealably received within the cylinders 24, 26 respectively. The disclosed compressor may generally be used for a pressure application.

Figure 4:
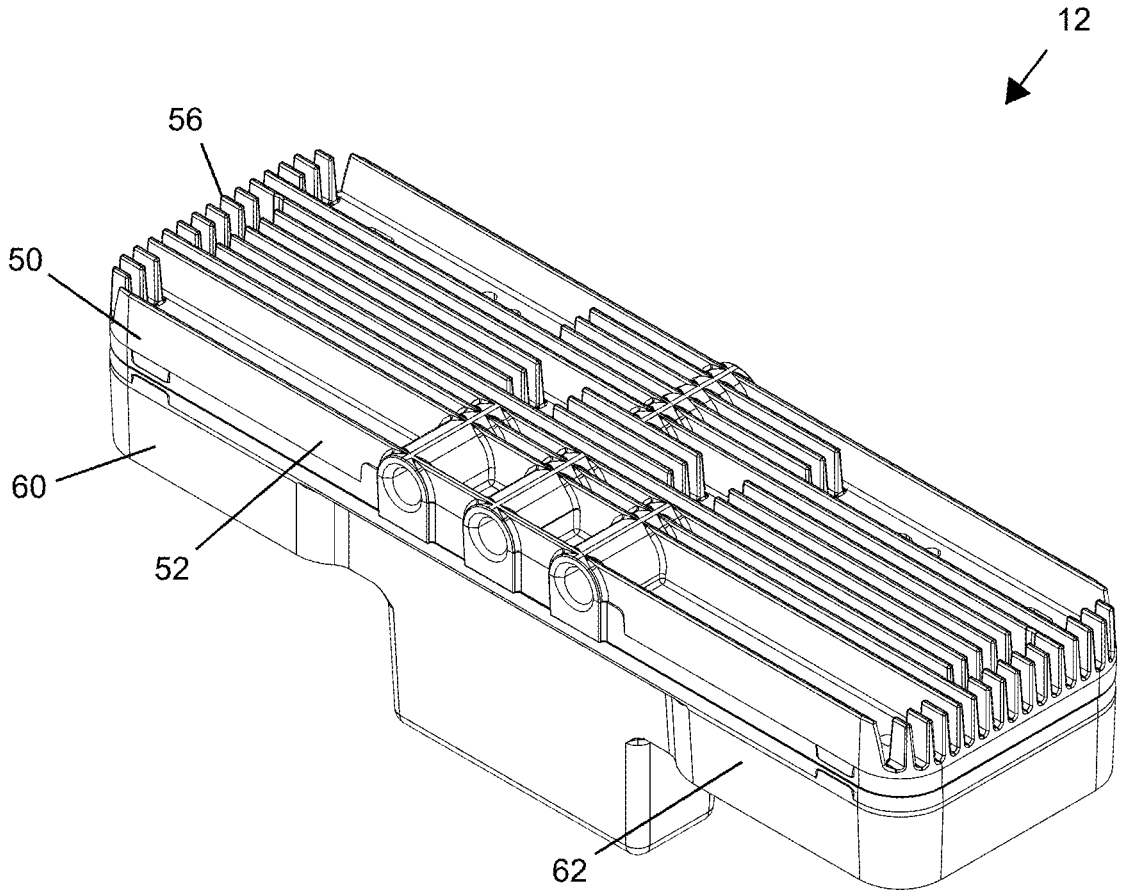
FIG. 4 provides a perspective view of the compressor head assembly.
Figure 4A:
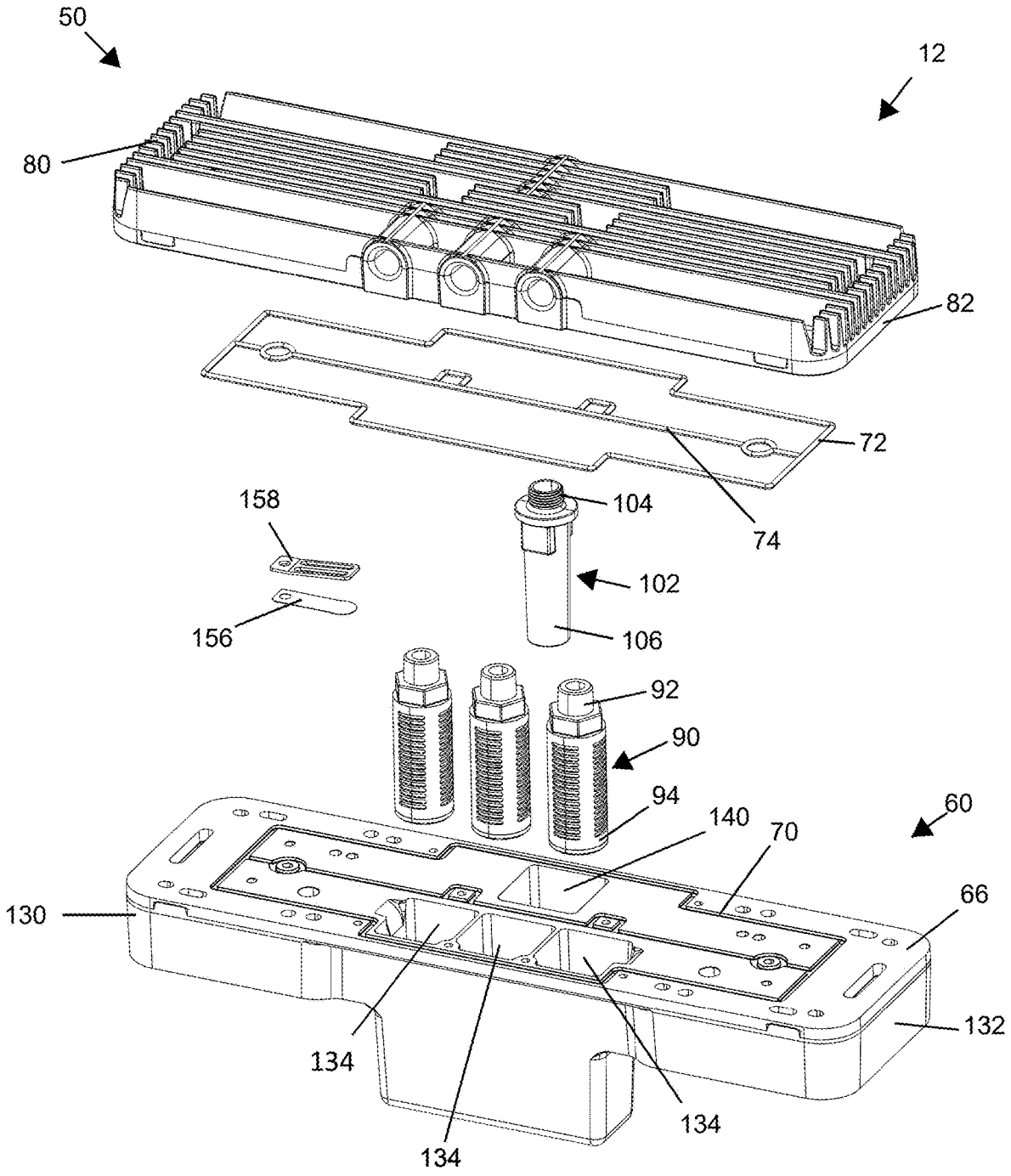
FIG. 4*a* provides an exploded perspective view of the compressor head assembly with three silencers.

As illustrated in FIGS. 4 and 4*a*, the head assembly 12 may comprise a head plate 50 operably connected to a valve plate 60. The head plate 50 may comprise a front surface 52, a back surface 54, a top 56, and a bottom 58. Similarly, the valve plate 60 may comprise a front surface 62, a back surface 64, a top 66, a bottom 68, and an o-ring groove 70. The head assembly 12 may further comprise an o-ring 72 disposed between the head plate 50 and the valve plate 60 such that the o-ring 72 is seated in the o-ring groove 70. The o-ring 72 may be compressed between the plates 50, 60 when the plates are assembled together and may form a seal relationship between the head plate 50, the valve plate 60, and the plate's components described in further detail below. While an exemplary implementation comprises an o-ring, as illustrated in FIG. 4*a*, it should be appreciated that other sealing means like a gasket may be used to create the seal relationship between the plates. In another implementation, the head assembly 12 may comprise a single valve plate having all of the features of the head plate 50 and the valve plate 60 that are described in further detail below. In yet another implementation, the head assembly 12 may have more plates than a separate head plate 50 and a valve plate 60. For instance, the head assembly 12 may have three, four, or any suitable number of plates determined by sound engineering judgement that can be coupled together to have the same characteristics of the described valve and head plates. In one implementation, the head assembly 12 may be selectably attachable such that the head assembly 12 can be retrofit to existing compressors.

Figure 5:
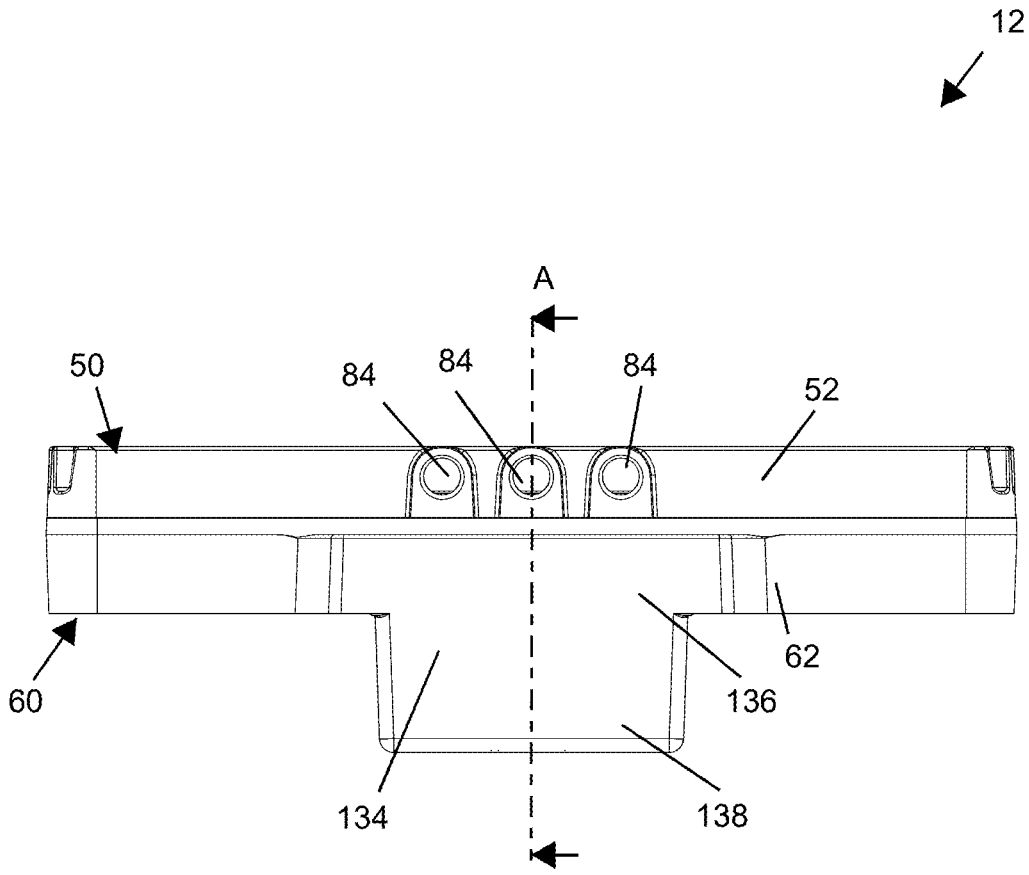
FIG. 5 provides a front view of the compressor head assembly.
Figure 6:
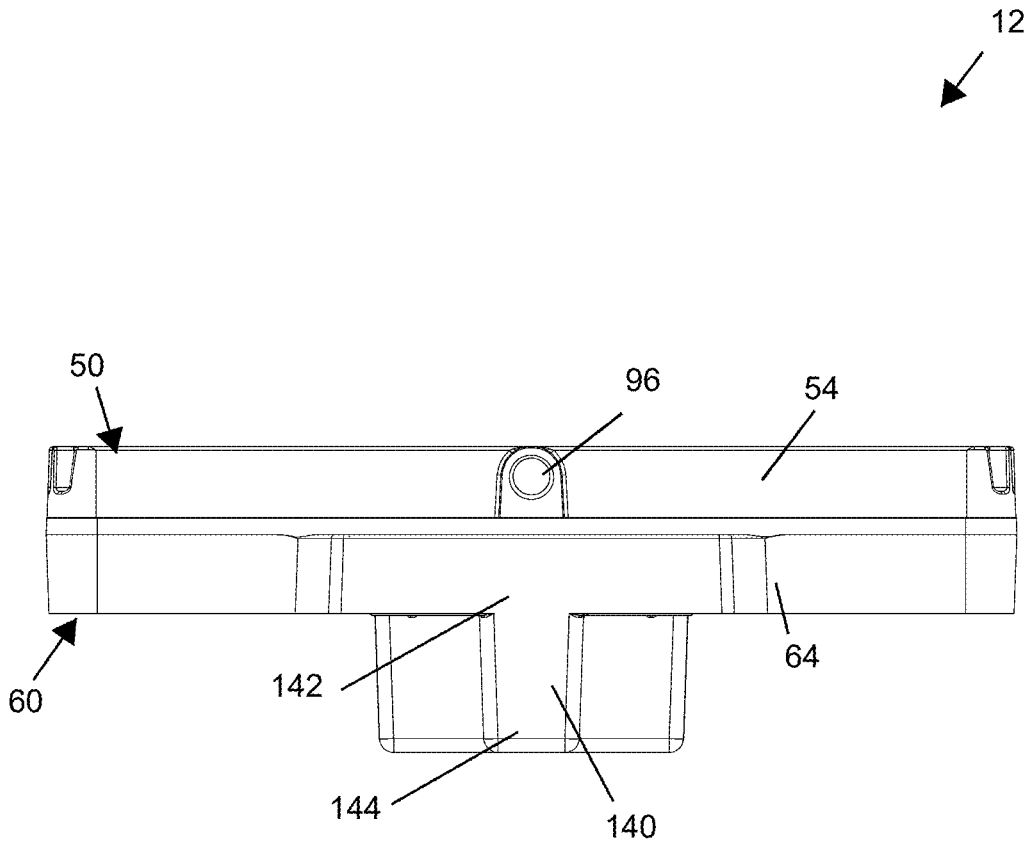
FIG. 6 provides a back view of the compressor head assembly.
Figure 7:
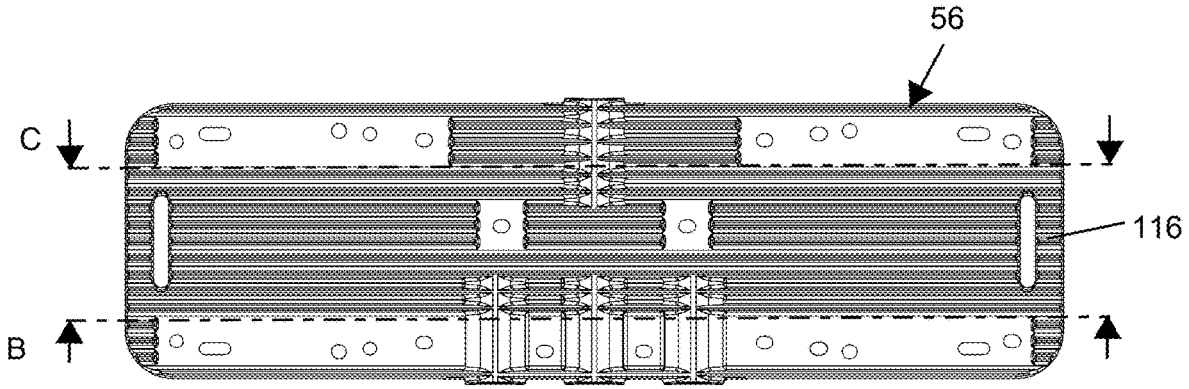
FIG. 7 provides a top view of the head plate.

As shown in FIGS. 5, 6, 7, and 8, in addition to the front surface 52, the back surface 54, the top 56, and the bottom 58, the head plate 50 may further comprise a head plate first end 80 and a head plate second end 82. The head plate first and second ends 80, 82 may be substantially similar. As illustrated in FIG. 5, the head plate front surface 52 may comprise a plurality of inlets 84. The plurality of inlets 84 may be in fluid communication with the compressor's ambient environment and with a plurality of inlet elbows 86 disposed within head plate 50. In one implementation illustrated in FIG. 5, the head plate 50 comprises three inlets 84. It should be appreciated that in other implementations, any number of inlets may be used to provide air to the compressor. Depending on the configuration and desired performance of the head assembly, one or multiple of the inlets may be plugged to prevent air flow through the inlet. The plug may be held in place by a threaded fastener connection, like a set screw, a pin, friction fit, or some other suitable fastening means. For example, in one implementation, one silencer may be operably connected to either the first silencer port, the second first silencer port, or the third first silencer port. If two silencers are utilized, the silencers may be operably connected to the first and second first silencer ports, the second and third first silencer ports, or the first and third first silencer ports. In yet another implementation, three silencers may be utilized simultaneously, one operably connected to each silencer port. It is also contemplated that the silencers may be operably connected to other components, such as the inlets to achieve a quieter compressor. As illustrated in FIG. 6, the head plate back surface 54 may comprise an external exhaust port 96. The external exhaust port 96 may be in fluid communication with an exhaust elbow 98 disposed within the head plate 50. While the exemplary implementation of the head plate 50 comprises one external exhaust port 96, it should be appreciated that any number of external exhaust ports 96 and exhaust elbows 98 may be used with the air compressor. As shown in FIG. 7, the head plate top 56 may comprise a plurality of heat fins 116. The heat fins dissipate heat by increasing the surface area of the head plate top 56 that is exposed to cooler ambient air. The head plate top 56 may be substantially covered with heat fins 116 to maximize the cooling effect of the heat fins.

Figure 8:
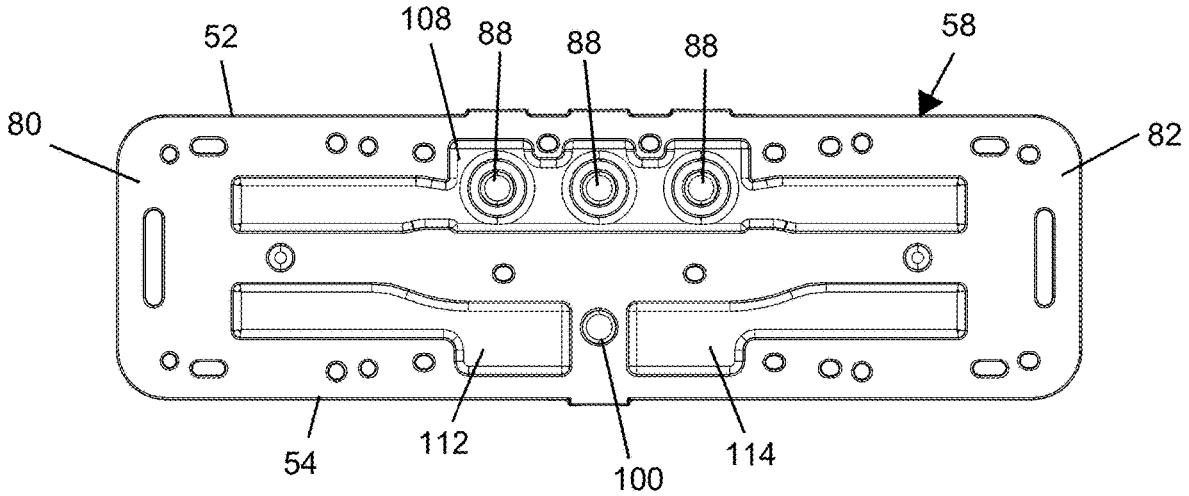
FIG. 8 provides a bottom view of the head plate.
Figure 9:
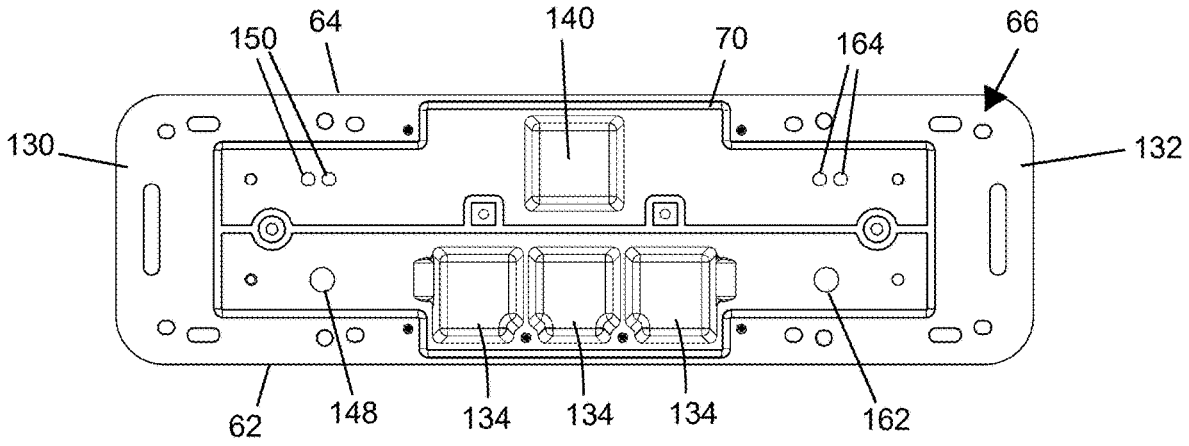
FIG. 9 provides a top view of the valve plate.

As shown in FIG. 8, the head plate bottom 58 may comprise at least one silencer port 88 proximate the head plate front surface 52. Each of the at least one silencer ports 88 may be in fluid communication with one of the plurality of inlet elbows 86. The at least one silencer port 88 may be configured to receive a silencer as described in detail below. The head plate bottom 58 may further comprise of an air tube port 100 proximate the head plate back surface 54. The air tube port 100 may be in fluid communication with the exhaust elbow 98. The air tube port 100 may be configured to receive an air tube as described in detail below. The head plate bottom 58 may further comprise a head plate inlet chamber 108 that extends from the head plate first end 80 to the head plate second end 82. Alternatively, the head plate bottom may comprise a first head plate inlet chamber disposed in the head plate first end 80 and a second head plate inlet chamber disposed in the head plate second end 82. The inlet chamber 108 may be proximate the head plate front surface 52. The head plate bottom 58 may further comprise a first head plate exhaust chamber 112 disposed in the head plate first end 80 and a second head plate exhaust chamber 114 disposed in the head plate second end 82. The first and second exhaust chambers 112, 114 may be proximate the head plate back surface 54. The o-ring 72 disposed between the head plate 50 and the valve plate 60 may comprise a divider 74 that provides a seal relationship between head plate 50 and the valve plate 60 and separates the first and second inlet chambers 108 from the first and second exhaust chambers 112, 114.

Figure 4B:
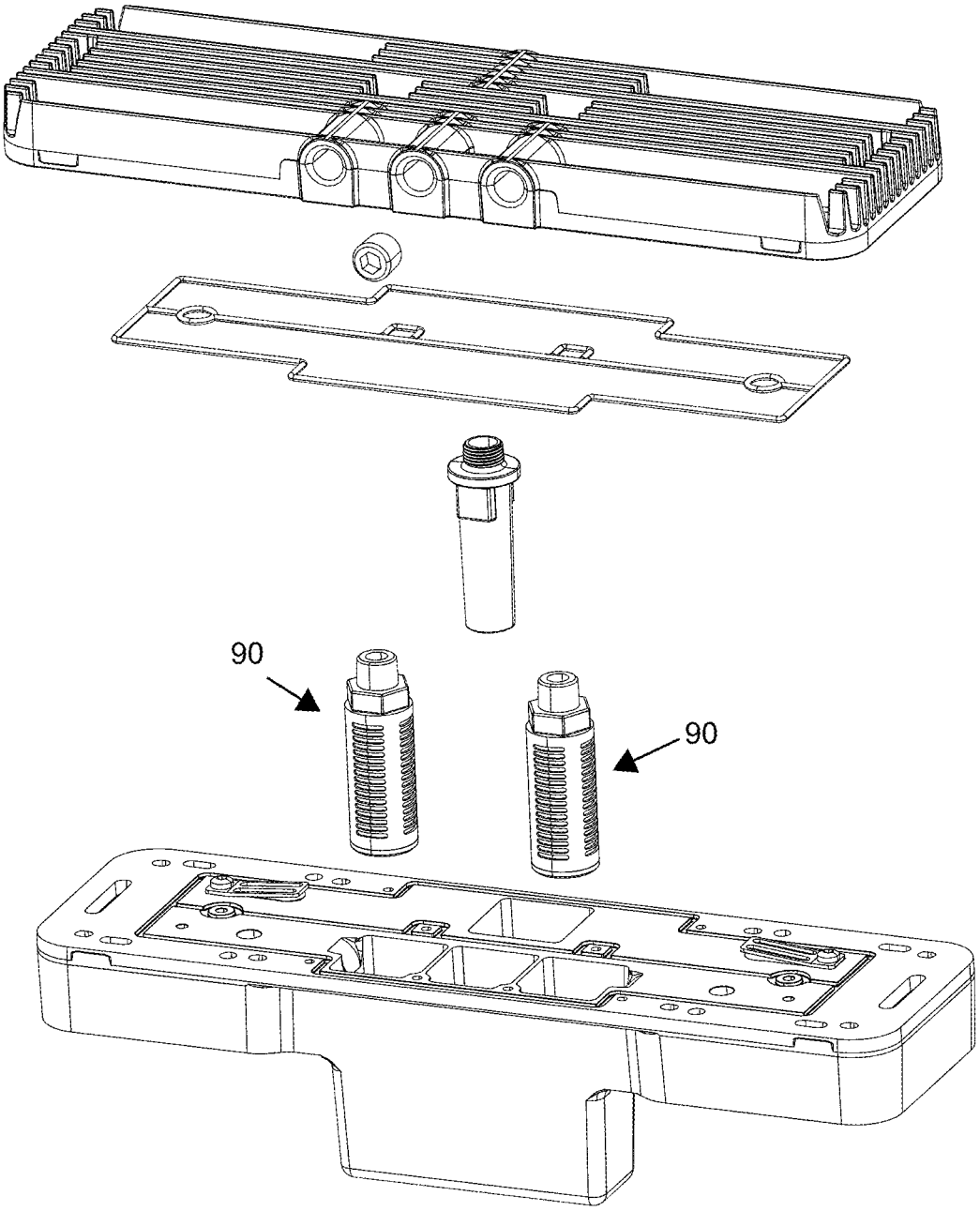
FIG. 4*b* provides an exploded perspective view of the compressor head assembly with two silencers.
Figure 4C:
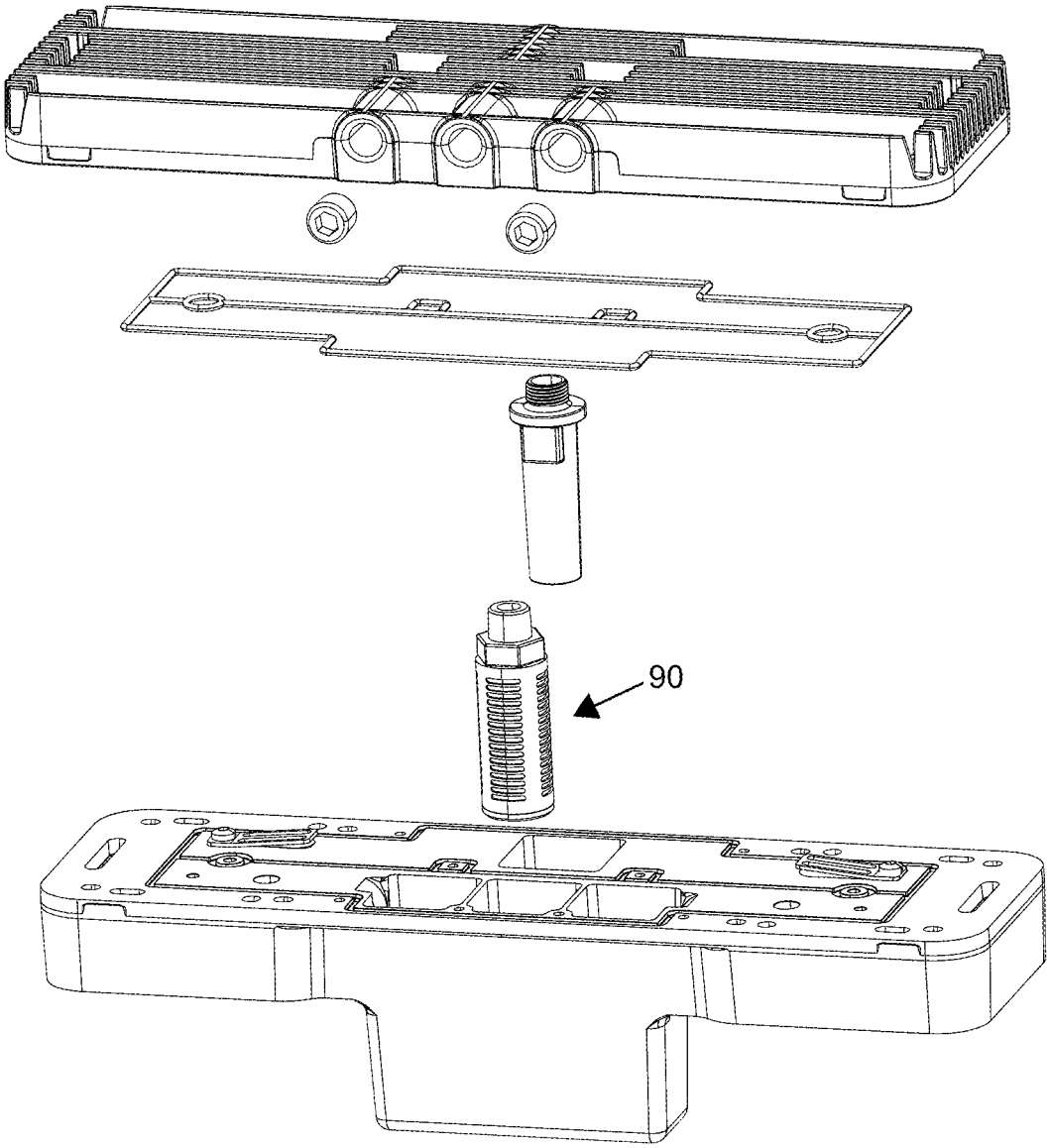
FIG. 4*c* provides an exploded perspective view of the compressor head assembly with one silencer.

As illustrated in FIG. 4*a*, the head assembly 12 may further comprise at least one silencer 90. Each silencer 90 may have a first end 92 and a second end 94. The silencer first end 92 may be operably and selectably coupled to one of the plurality of silencer ports 88 on the head plate bottom 58 such that each silencer 90 is in fluid communication with an silencer port 88 and therefore an inlet elbow 86 and an inlet 84. For instance, at least one silencer 90 may couple with the silencer ports 88 by a threaded connection. In the illustrated implementation, the at least one silencer 90 may be configured in parallel with respect to each other. It should be appreciated that, any number of silencers may be used with the head assembly depending on the number of silencer ports and the desired performance of the head assembly. In one implementation, illustrated in FIGS. 4*a* and 15, the head assembly 12 may have three silencers 90. In another implementation, illustrated in FIG. 4*b*, the head assembly may 12 have two silencers 90. In yet another implementation, illustrated in FIG. 4*c*, the head assembly 12 may have one silencer 90. It should be appreciated that the head assembly may have less silencers than corresponding silencer ports. In this instance, the silencer ports that do not have a silencer coupled to it can be plugged.

Figure 14:
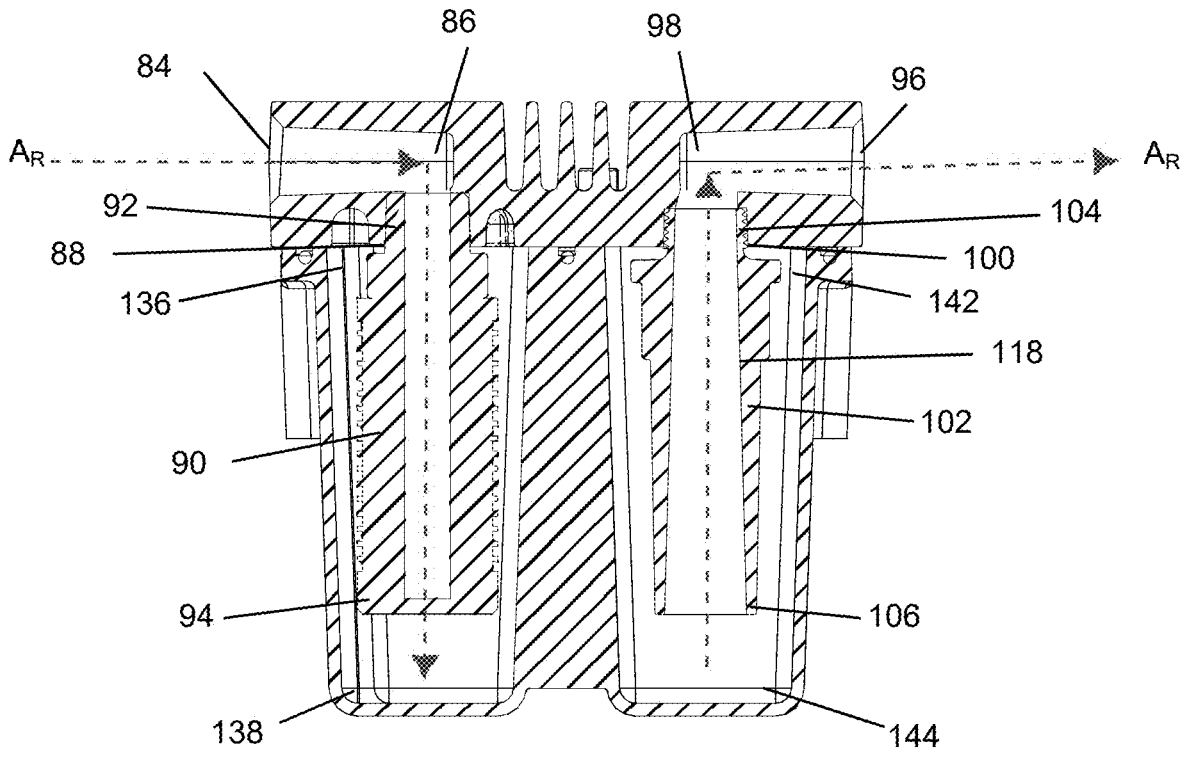
FIG. 14 shows cross section A and provides a cross section of the head assembly inlets and exhaust.

The head assembly 12 may further comprise an air tube 102 having a first end 104 and a second end 106. The air tube first end 104 may be operably and selectably coupled with head plate bottom air tube port 100 such that it is in fluid communication with the air tube port 100 and therefore the exhaust elbow 98 and external exhaust port 96. For instance, the air tube 102 may couple with the air tube port 100 by a threaded connection. The air tube 102 may be a generally cylindrical tube having an air tube length $L_A$ and an air tube inner surface 118 defined by an air tube inner diameter $D_A$. As shown in FIG. 14, the air tube inner diameter $D_A$ at the air tube first end 104 may be less than the air tube inner diameter $D_A$ at the air tube second end 106 such that the air tube inner surface 118 is wider at the air tube second end 106 and continually tapers toward the air tube first end 104. The air tube may be made out of a polymer, composite, metal (like aluminum), or any other temperature resistant material.

Figure 10:
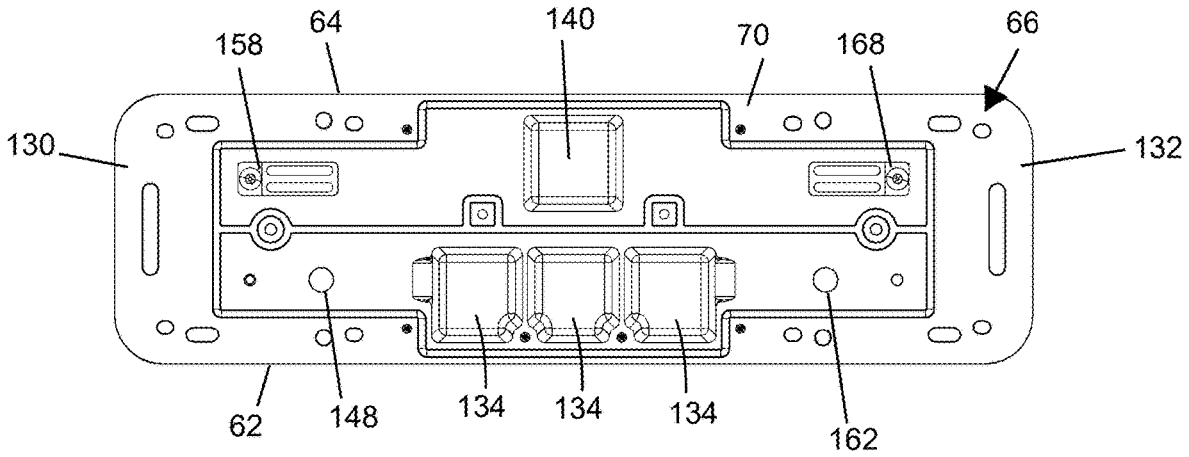
FIG. 10 provides a top view of the head plate and further illustrates leaf valves and limiters over the cylinder exhaust ports FIG. 11 provides a bottom view of the valve plate.
Figure 11:
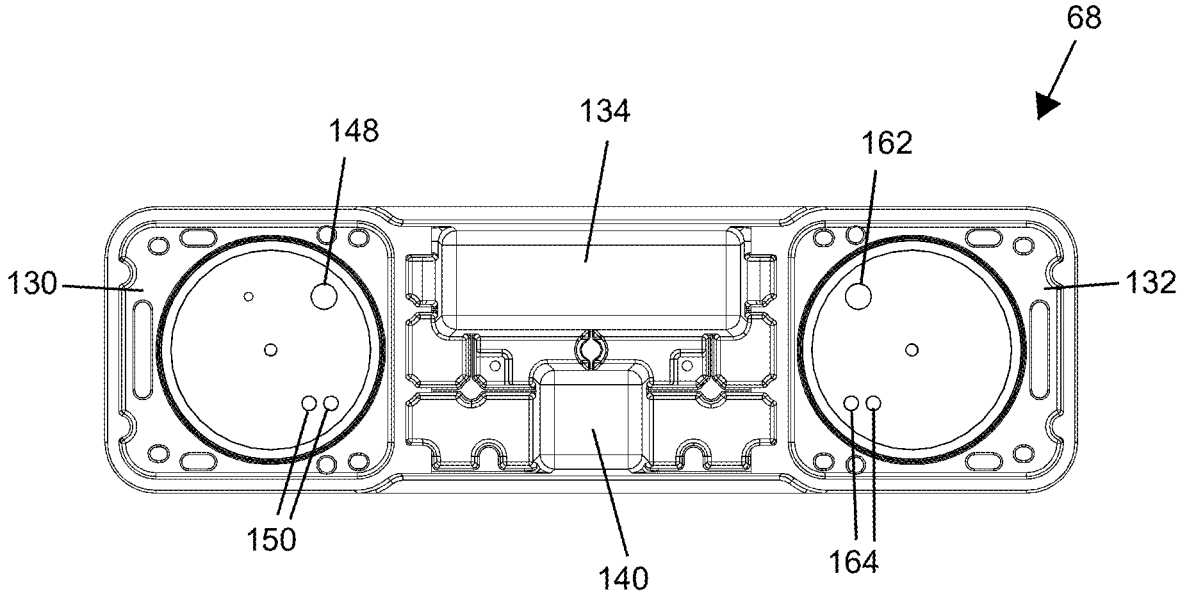
Figure 12:
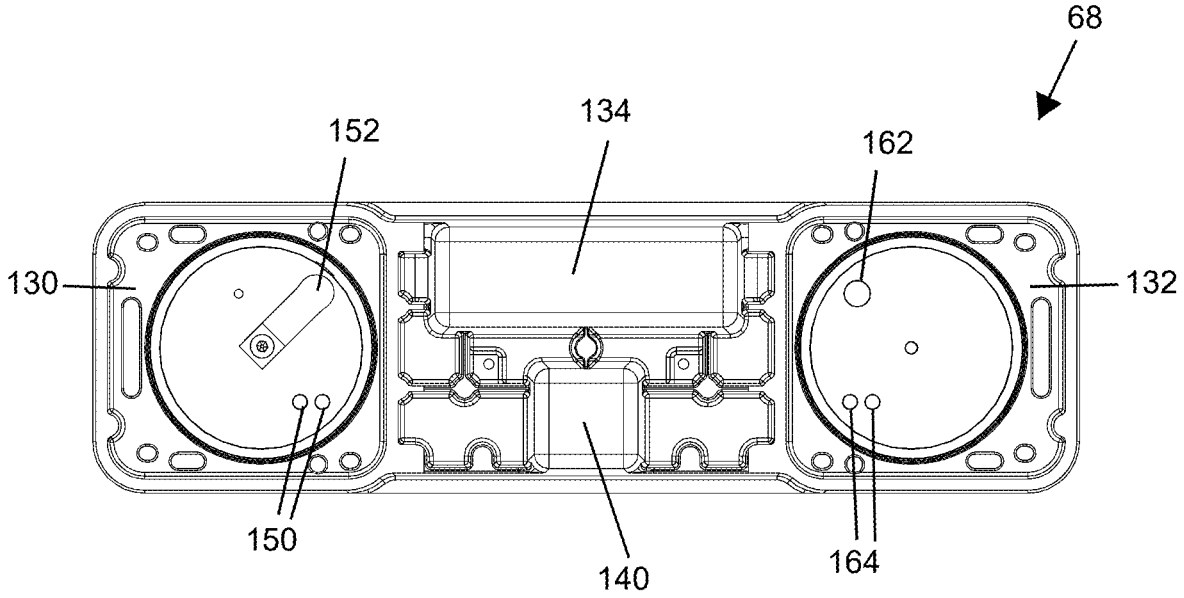
FIG. 12 provides a bottom view of the head plate and further illustrates leaf valves and limiters over the cylinder intake ports.
Figure 15:
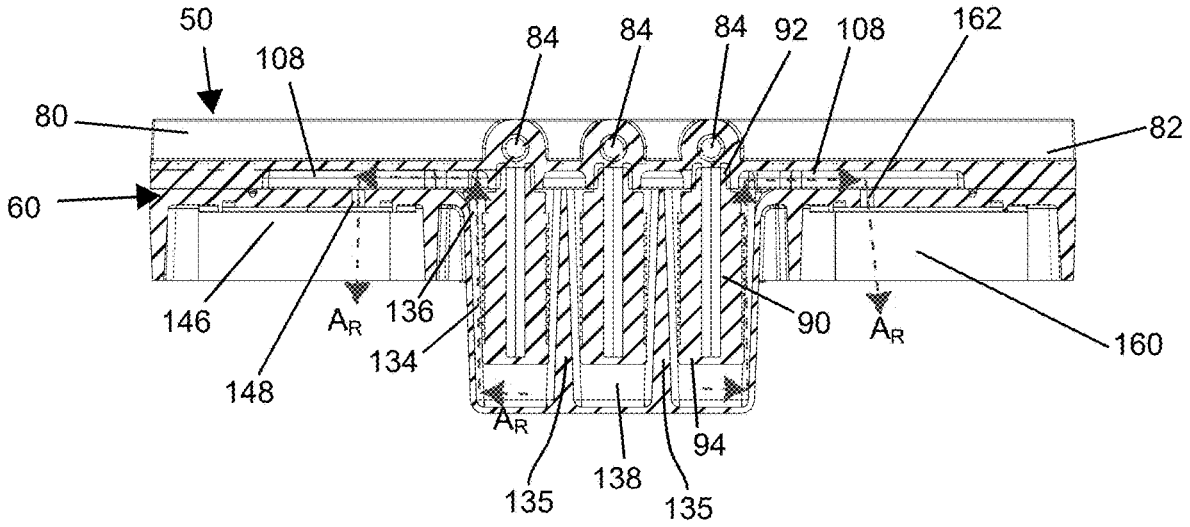
FIG. 15 shows cross section B and provides a cross section of the head assembly attenuation chamber.

As illustrated in FIGS. 9, 10, 11, and 12, the valve plate 60 may comprise a front surface 62, a back surface 64, a top 66, and a bottom 68. The valve plate 60 may further comprise at least one attenuation chamber 134 having an attenuation chamber top 136 and an attenuation chamber bottom 138. The attenuation chamber 134 may be proximate the valve plate front surface 62. The at least one attenuation chamber 134 may comprise at least one dividing wall 135 extending from the bottom of the attenuation chamber bottom 138 to the attenuation chamber top 136 as shown in FIG. 15. The at least one dividing wall 135 may divide the attenuation chamber into a plurality of separate attenuation chambers 134. For instance as shown in FIG. 10, the valve plate 60 may have three attenuation chambers 134 defined by two dividing walls 135. The dividing walls 135 may generally increase the strength, and prevent undesirable twisting, of the valve plate. The valve plate may also comprise an exhaust chamber 140 having an exhaust chamber top 142 and an exhaust chamber bottom 144. The exhaust chamber 140 may be proximate the valve plate back surface 64. The valve plate 60 may further comprise a valve plate first end 130 and a valve plate second end 132.

As illustrated in FIGS. 4 and 4*a*, when assembled, the head assembly 12 may be configured such that the head plate front surface 52 is proximate the valve plate front surface 62, the head plate back surface 54 is proximate the valve plate back surface 64, the head plate first end 80 is proximate the valve plate first end 130, and the head plate second end 82 is proximate the valve plate second end 132. In this configuration, the at least one silencer 90 may be at least partially disposed or fully disposed within the at least one attenuation chamber 134 such that the silencer second end 94 is proximate the attenuation chamber bottom 138. In this configuration, the air tube 102 may be disposed within the exhaust chamber 140 such that the air tube second end 106 is proximate the exhaust chamber bottom 144. In an exemplary implementation with three silencers 90 and three attenuation chambers 134, each silencer 90 is disposed within a corresponding attenuation chamber 134. When assembled, the head plate inlet chamber 108 and the head plate exhaust chamber 112 provides gapping between the head plate 50 and the valve plate 60 to allow air flow through the head assembly 12. As illustrated in FIGS. 14 and 15, the head plate 50 may have gapping around the at least one silencer ports 88 providing fluid communication between the sound attenuation chambers 134 and the head plate inlet chamber 108.

Returning to FIGS. 9, 10, 11, and 12, the valve plate first end 130 and the valve plate second end 132 may be substantially similar. The valve plate first end 130 may comprise a first cylinder chamber 146 extending from the valve plate bottom 68. The first cylinder chamber 146 may be disposed over the first cylinder 24. The valve plate first end 130 may further comprise a first end intake port 148 that may extend through the valve plate 60 from the valve plate top 66 to the valve plate bottom 68. The first end intake port 148 may be in fluid communication with the first cylinder chamber 146 and the head plate inlet chamber 108. A first end cylinder intake leaf valve 152 may be operably connected, such as mechanically or electro-mechanically connected, to the valve plate bottom 68 in the first cylinder chamber 146 and may disposed over the first end intake port 148. A first end intake limiter 154 may be operably connected, such as mechanically or electro-mechanically connected, to the valve plate bottom 68 in the first cylinder chamber 146. The first end intake limiter 154 may be disposed below the first end cylinder intake leaf valve 152 such that the limiter 154 limits the range of motion of the leaf valve 152.

The valve plate first end 130 may further comprise two first end cylinder discharge ports 150 that may extend through the valve plate 60 from the valve plate top 66 to the valve plate bottom 68. The first end cylinder discharge ports 150 may be in fluid communication with the first cylinder chamber 146 and the first head plate exhaust chamber 112. The two cylinder discharge ports 150 may have exactly one-half of the area of the first end cylinder intake port 148. While the present implementation includes two cylinder discharge ports 150, it should be appreciated that other implementations may include one or more cylinder discharge ports. Additionally, it should be appreciated that the cylinder discharge ports 150 may have dimensions such that they are not exactly one-half the area of the intake port 148. A first end cylinder discharge leaf valve 156 may be operably connected, such as mechanically or electro-mechanically connected, to the valve plate top 66. The first end cylinder discharge leaf valve 156 may be disposed over the two first end cylinder discharge ports 150. A first end discharge limiter 158 may be operably connected, such as mechanically or electro-mechanically connected, to the valve plate top 66. The first end discharge limiter 158 may be disposed above the first end cylinder discharge leaf valve 156 such that the discharge limiter 158 limits the range of motion of the leaf valve 156. In this configuration, the first end discharge leaf valve 156 and first end discharge limiter 158 may be disposed in the first head plate exhaust chamber 112 when the head plate 50 and the valve plate 60 are assembled. While the intake leaf valve 152 and the discharge leaf valve 156 are described herein, it should be understood that any one-way directional valve may be utilized that is chosen with sound engineering judgment.

The valve plate second end 132 may comprise a second cylinder chamber 160 extending from the valve plate bottom 68. The second cylinder chamber 160 may be disposed over the second cylinder 26 of the motor assembly 14. The valve plate second end 132 may further comprise a second end intake port 162 that may extend through the valve plate 60 from the valve plate top 66 to the valve plate bottom 68. The second end intake port 162 may be in fluid communication with the second cylinder chamber 160 and the head plate inlet chamber 108. A second end cylinder intake leaf valve 166 may be operably connected, such as mechanically or electro-mechanically connected, to the valve plate bottom 68 in the second cylinder chamber 160 and may disposed over the second end intake port 162. A second end intake limiter 168 may be operably connected, such as mechanically or electro-mechanically connected, to the valve plate bottom 68 in the second cylinder chamber 160. The second end intake limiter 168 may be disposed below the second end cylinder intake leaf valve 166 such that the limiter 168 limits the range of motion of the leaf valve 166.

The valve plate second end 132 may further comprise two second end cylinder discharge ports 164 that may extend through the valve plate 60 from the valve plate top 66 to the valve plate bottom 68. The second end cylinder discharge ports 164 may be in fluid communication with the second cylinder chamber 160 and the second head plate exhaust chamber 114. The two cylinder discharge ports 164 may have exactly one-half the area of the second end intake port 162. While the present implementation includes two cylinder discharge ports 164, it should be appreciated that other implementations may include one or more cylinder discharge ports. Additionally, it should be appreciated that the cylinder discharge ports 164 may have dimensions such that they are not exactly one-half of the area of the cylinder intake port 162. A second end cylinder discharge leaf valve 170 may be operably connected, such as mechanically or electro-mechanically connected, to the valve plate top 66. The second end cylinder discharge leaf valve 170 may be disposed over the two second end cylinder discharge ports 164. A second end cylinder discharge limiter 172 may be operably connected, such as mechanically or electro-mechanically connected, to the valve plate top 66. The second end discharge limiter 172 may be disposed above the second end cylinder discharge leaf valve 170 such that the limiter 172 limits the range of motion of the leaf valve 170. In this configuration, the second end discharge leaf valve 170 and second end discharge limiter 172 may be disposed in the second head plate exhaust chamber 114 when the head plate 50 and the valve plate 60 are assembled.

Figure 13:
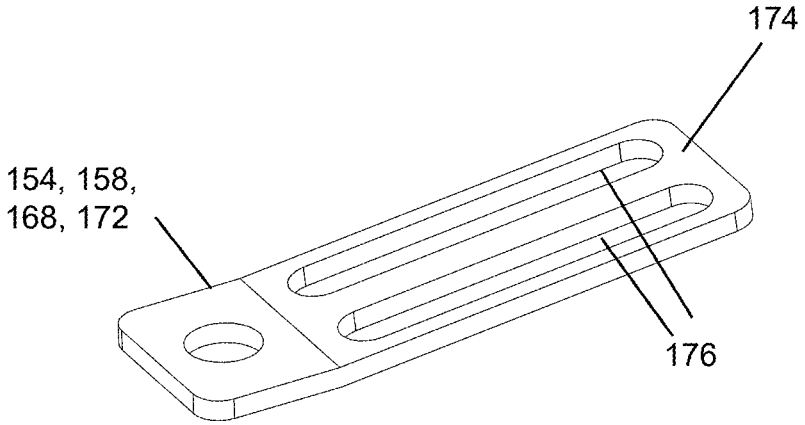
FIG. 13 provides a perspective view of an exemplary intake or discharge limiter.

Referring to FIG. 13, the intake and discharge limiters 154, 158, 168, 172, described herein, are generally disposed over the leaf valves 152, 156, 166, 170 to prevent the leaf valves from being blown out of place during operation of the compressor. The intake and discharge limiters 154, 158, 168, 172 may comprise a top surface 174. The intake and discharge limiters may further comprise a plurality of slots 176 or grooves in the top surface 174 to minimize the surface area of the limiter. The limiter slots 176 may reduce the force placed on the leaf valves 152, 156, 166, 170 during the operation of the pump. Additionally, the limiters 154, 158, 168, 172 may reduce the mechanical noise generated by the valves and limiters common during the operation of the pump.

Figure 16:
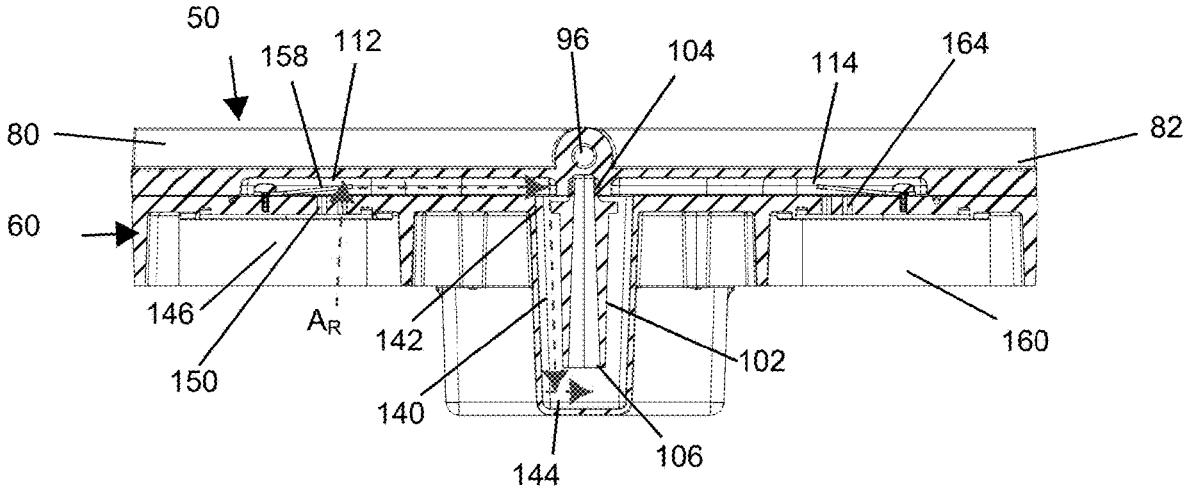
FIG. 16 shows cross section C and provides a cross section of the head assembly exhaust chamber.

The dual cylinder rocking piston-type compressor, described herein, generally functions in the following manner. Air flows through the compressor 10 as indicated by air reference lines $A_R$ in FIGS. 14, 15, and 16. As illustrated in FIG. 14, air is drawn in from the ambient environment through the plurality of inlets 84. In an implementation where an inlet 84 is plugged because there are less silencers 90 than inlets 84, less air may be drawn in from the ambient environment which may decrease the full advantages of the sound attenuation chamber of the compressor. From the plurality of inlets 84, the air moves through the plurality of inlet elbows 86 to the plurality of silencer ports 88 on the head plate bottom 58. The air moves from silencer first end 92 coupled to the silencer port 88 to the silencer second end 94 proximate the attenuation chamber bottom 138. It should be appreciated that each silencer 90 is providing air to one of the attenuation chambers 134 and all of the attenuation chambers are plumbed in parallel with respect to each other by the inlet chamber 108 of the head plate. Air moves from the attenuation chamber bottom 138 to attenuation chamber top 136 and into the head plate inlet chamber 108. Air moves from the head plate inlet chamber 108 into the cylinder chambers 146, 160 through cylinder intake ports 148, 162 when cylinder intake leaf valves 152, 166 are open. The air is compressed in the cylinder chambers 146, 160.

After the air is compressed in the cylinder chambers 146, 160, the air moves into the first and second head plate exhaust chambers 112,114 through the cylinder discharge ports 150, 164 when the cylinder discharge leaf valves 156, 170 are open. The air moves through the first and second head plate exhaust chambers 112, 114 to the exhaust chamber top 142. The air moves from the exhaust chamber top 142 to the exhaust chamber bottom 144 and into the air tube second end 106. Then the air moves from the air tube second end 106 to the air tube first end 104 and into the exhaust elbow 98. It should be appreciated that because the air tube inner surface 118 becomes narrower toward the air tube first end 104, described in detail above, the air flow increases, in other words, accelerates, as the air moves from the air tube second end 106 to the air tube first end 104. From the exhaust elbow 98, the air is expelled out of the external exhaust port 96 and into the ambient environment.

Generally, in a dual rocking-piston type compressor, the rocking piston assemblies are 180 degree out of phase with each other. Specifically, when one rocking piston assembly is performing an exhaust stroke, the other rocking piston assembly is performing an intake stroke. For instance, if the first rocking-piston assembly is performing an intake stroke, air may be drawn through the inlets, into the sound attenuation chambers, into the head first inlet chamber, through the first intake port and into the first cylinder chamber. Simultaneously, the second rocking piston assembly would be performing an exhaust stroke. In the exhaust stroke, the air would move from the second cylinder chamber, through the second end discharge ports to the second head exhaust chamber, to the exhaust chamber, through the air tube and out the external exhaust.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A rocking piston compressor head assembly, comprising:

a head plate having at least one inlet, at least one silencer port, an air tube port, and an external exhaust port;

a valve plate configured to be operably coupled to the head plate and having a sound attenuation chamber and an exhaust chamber;

at least one silencer, wherein the at least one silencer is operably and selectably coupled to the at least one silencer port and disposed within the sound attenuation chamber; and an air tube comprising a first end operably and selectably coupled to the air tube port and a second end opposite the first end, the air tube configured to accelerate air flow from the second end toward the first end.

2. The rocking piston compressor head assembly of claim 1, further comprising a plurality of silencer ports and a plurality of silencers, wherein each silencer is selectably engaged with the at least one of the silencer ports.

3. The rocking piston compressor head assembly of claim 2, wherein the plurality of silencer ports is two silencer ports and the plurality of silencers is two silencers, each silencer is selectably engaged with one of the silencer ports.

4. The rocking piston compressor head assembly of claim 2 wherein the plurality of silencers is three silencers and the plurality of silencer ports is three silencer ports, wherein each silencer is selectably engaged with one of the silencer ports.

5. The rocking piston compressor head assembly of claim 4, wherein the valve plate's first and second ends each have two discharge ports.

6. The rocking piston compressor head assembly of claim 2, wherein each individual silencer is disposed in a corresponding sound attenuation chamber.

7. The rocking piston compressor head assembly of claim 1, wherein the rocking piston compressor head assembly is selectably connected to a compressor.

8. The rocking piston compressor head assembly of claim 1, the sound attenuation chamber having a plurality of internal walls that extend from a bottom of the sound attenuation chamber to a top of the sound attenuation chamber defining a plurality of sound attenuation chambers, each of the plurality of sound attenuation chambers proximate each of the at least one silencer ports.

9. The rocking piston compressor head assembly of claim 1, the valve plate further comprising a first end and a second end, the first and second ends of the valve plate each having an intake port, an intake port leaf valve disposed over the intake port, at least one discharge port, and a discharge port leaf valve disposed proximate the at least one discharge port.

10. The rocking piston compressor head assembly of claim 9, the first and second ends each further comprising an intake port limiter configured to limit the range of motion of the intake port leaf valve and a discharge port limiter configured to limit the range of motion of the discharge port leaf valve.

11. The rocking piston compressor head assembly of claim 10, wherein the intake port limiters and the discharge port limiters have slots defined therein that extend through the intake port limiters and the discharge port limiters respectively.

12. The rocking piston compressor head assembly of claim 9, wherein the at least one first end's discharge port has one-half of the area of the first end's intake port and the at least one second end's discharge port has one-half the area of the second end's intake port.

13. The rocking piston compressor head assembly of claim 1, the air tube further comprising an inner surface defined by an air tube inner diameter, wherein the air tube inner diameter at the first end is smaller than the air tube inner diameter at the second end such that the inner surface tapers from the second end of the air tube to the first end of the air tube.

14. The rocking piston compressor head assembly of claim 1, the head plate further comprising heat fins.

15. A rocking piston compressor head assembly, comprising:

a head plate having at least one inlet, at least one silencer port, an air tube port, and an external exhaust port;

a valve plate configured to be operably coupled to the head plate and having a sound attenuation chamber, an exhaust chamber, a first end, and a second end, the first and second ends of the valve plate each having an intake port, an intake port leaf valve disposed over the intake port, a plurality of discharge ports, and a discharge port leaf valve disposed proximate the plurality of discharge ports;

a plurality of silencers, wherein each silencer is operably and selectably coupled to a corresponding head plate silencer port and disposed within the sound attenuation chamber;

an air tube comprising a first end operably and selectably coupled to the air tube port and a second end opposite the first end, the air tube configured to accelerate air flow from the second end of the air tube toward the first end of the air tube; and wherein the plurality of discharge ports of the first end of the valve plate have one-half of the area of the intake port of the first end of the valve plate and the plurality of discharge ports of the second end of the valve plate have one-half the area of the intake port of the second end of the valve plate.

* * * * *